US005813271A

United States Patent [19]

Lee et al.

[11] Patent Number: 5,813,271

[45] Date of Patent: Sep. 29, 1998

[54] METHOD OF MANUFACTURING FRAME FOR CATHODE RAY TUBE

[75] Inventors: Eun Sub Lee; Kyung Yul An, both of Kyungsangbuk-do, Rep. of Korea

[73] Assignee: Orion Metal Company Ltd., Gumi, Japan

[21] Appl. No.: 801,384

[22] Filed: Feb. 20, 1997

[51] Int. Cl.[6] ..... B21D 28/10

[52] U.S. Cl. ..... 72/336; 72/339

[58] Field of Search ..... 72/331, 336, 337, 72/339, 379.2, 329, 330, 404

[56] References Cited

U.S. PATENT DOCUMENTS

| | | | |
|---|---|---|---|
| 4,356,719 | 11/1982 | Sutherland | 72/336 |
| 5,247,825 | 9/1993 | Erickson | 72/339 |

FOREIGN PATENT DOCUMENTS

| | | | |
|---|---|---|---|
| 615108 | 2/1961 | Canada | 72/331 |
| 109600 | 7/1982 | Japan | 72/404 |
| 184532 | 11/1982 | Japan | 72/404 |
| 165239 | 7/1986 | Japan | 72/404 |
| 81023 | 4/1991 | Japan | 72/404 |

*Primary Examiner*—Daniel C. Crane

*Attorney, Agent, or Firm*—Jacobson, Price, Holman & Stern, PLLC

[57] ABSTRACT

A method of manufacturing a frame for cathode ray tubes includes the steps of blanking a workpiece while keeping junctions thereon and punching a transformable area of the workpiece to form pilot holes thereon, piercing the blanked portion into a TV or monitor screen shape, forming the edge of the screen-shape portion such that it bends inward, and drawing the formed portion to be molded into a frame while notching the junctions. The steps are performed in one press simultaneously or sequentially.

1 Claim, 3 Drawing Sheets

METHOD OF MANUFACTURING FRAME FOR CATHODE RAY TUBE

BACKGROUND OF THE INVENTION

1. Field of the Invention

The present invention relates to a method of manufacturing a frame for cathode ray tubes and, more particularly, to a method in which frame manufacturing steps are simultaneously carried out in one press.

2. Discussion of Related Art

Generally, the cathode ray tube for displaying a picture on the TV or monitor screen is installed using a frame. To display a clear picture on the screen, tolerance between the frame and the cathode ray tube should be strictly controlled. Thus, it is considered that high-precision is very important in the frame manufacturing technology.

The frame manufacturing process using a sheet metal usually includes the steps of drawing the workpiece to be molded into a predetermined shape, piercing the drawn part of the workpiece to form a hole having a desired shape therewithin, forming a frame having a desired shape out of the pierced hole, and at last trimming the edge of the frame.

However, the above process has a problem that a progressive method, in which all the steps are continuously performed, can be used therein but material loss occurs as much as scraps generated through the trimming operation. In particular, the material loss is enormously great in as large products as TV frames.

To reduce the material loss, a frame manufacturing method, in which blanking, drawing, piercing and forming steps are sequentially exercised, has been used.

However, although the material loss can be reduced using the method, all the steps cannot progressively proceed because the portion blanked through the first blanking step is detached from the extra part of the workpiece, and thus the next steps are separately exercised.

That is, the method, in which all the steps are progressively exercised, is ready to suffer material loss while the non-progressive method should proceed with complex and separate processing steps.

SUMMARY OF THE INVENTION

Accordingly, the present invention is directed to a method of manufacturing a frame for cathode ray tubes which substantially obviates one or more of the problems due to limitations and disadvantages of the related art.

An object of the present invention is to provide a method of manufacturing a frame for cathode ray tubes in which all the steps are progressively exercised while reducing material loss.

To achieve these and other advantages and in accordance with the purpose of the present invention, as embodied and broadly described, the frame manufacturing method, in which all the steps thereof are progressively exercised by installing blanking, piercing, forming and drawing molds in sequence between a punch holder and a die holder in a press such that they are arranged on the top and bottom of the press, includes the steps of blanking a workpiece while leaving junctions thereon and punching a transformable area of the workpiece to form pilot holes thereon, piercing the blanked portion, forming the pierced portion such that its edge bends inward after securing the workpiece by inserting pilot pins of the forming mold into the pilot holes, drawing the formed portion to be molded into a frame after securing the workpiece by the pilot pins while notching the junctions.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and with the description serve to explain the principles of the invention.

In the drawings:

FIGS. 1 and 2 are cross-sectional views of a press in which blanking, piercing, forming and drawing molds are installed in sequence according to a preferred embodiment of the present invention; and FIG. 3 is a plan view showing a molding process according to the present invention.

DETAILED DESCRIPTION OF PREFERRED EMBODIMENT

Reference will now be made in detail to the preferred embodiments of the present invention, examples of which are illustrated in the accompanying drawings.

Figure 1:
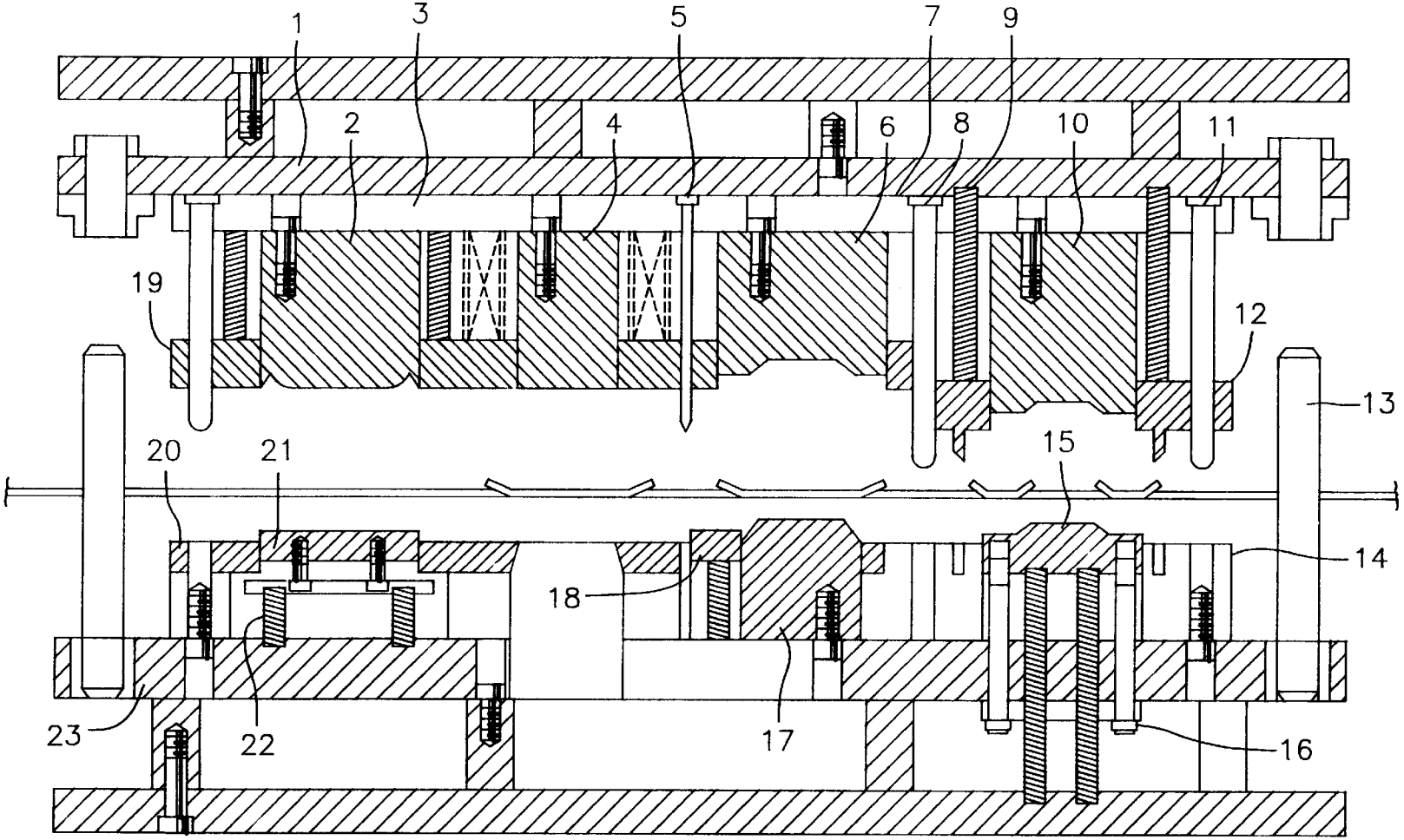
FIG. 1 is a cross-sectional view of the press in which the blanking, piercing, forming and drawing molds are installed in sequence while a workpiece made of a sheet metal is inserted when the top and bottom molds are spaced apart from each other before the processing.
Figure 2:
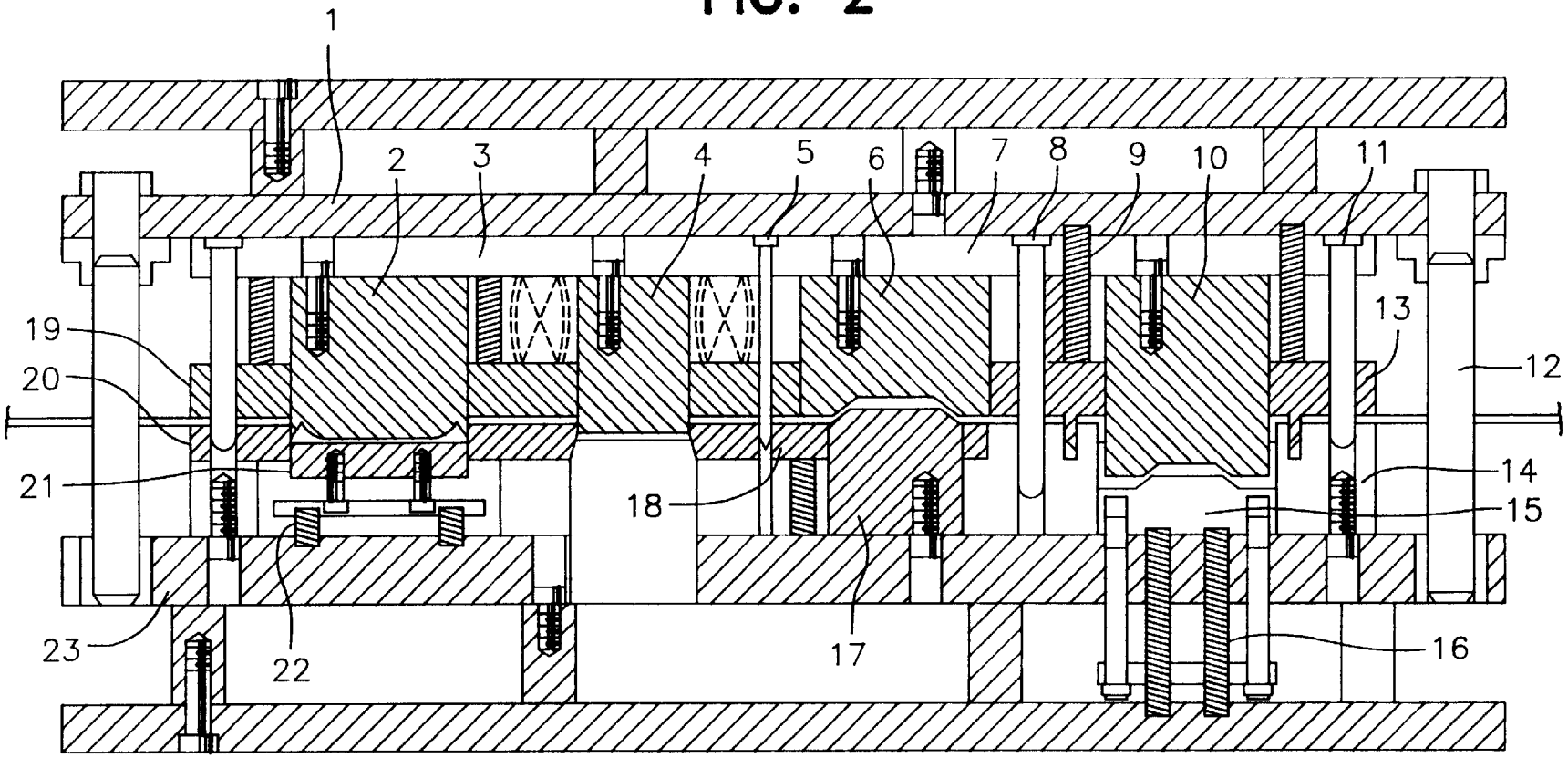
FIG. 2 is a cross-sectional view of the press in which the top and bottom molds combine with each other.
Figure 3:
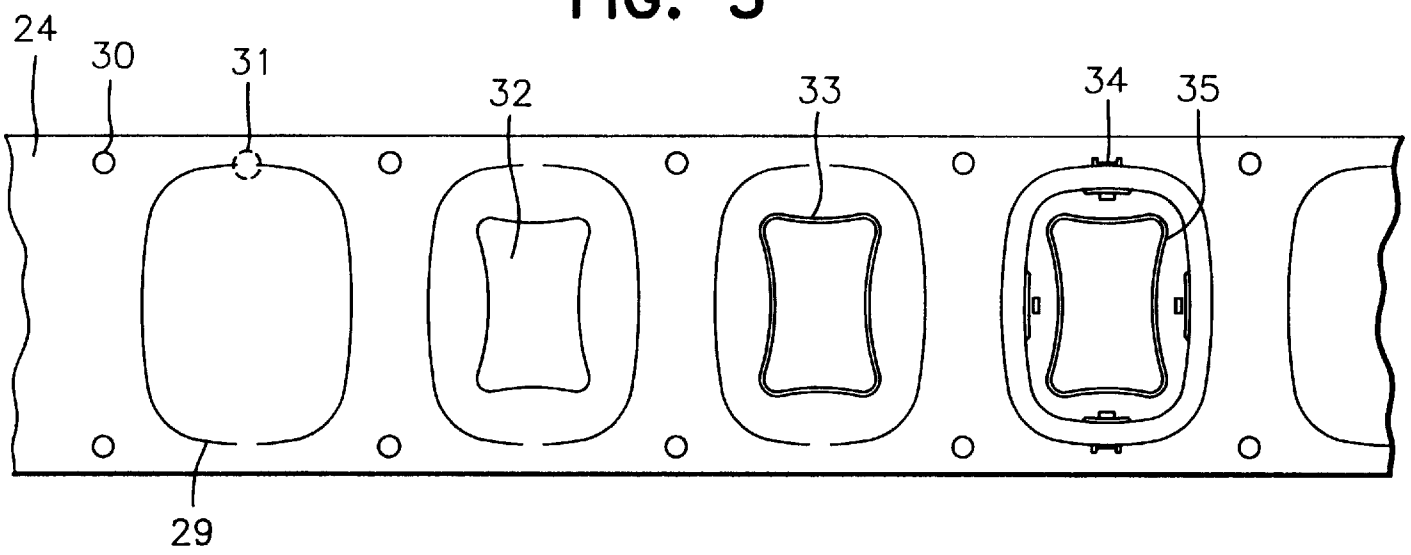
FIG. 3 is a plan view showing the process in which the workpiece is molded into a frame with the molds in accordance with up and down movement of the press.

As illustrated in FIGS. 1 and 2, a blanking mold 2, a piercing mold 4, a forming mold 6 and a drawing mold 10 are installed in sequence between a punch holder 1 and a die holder 23 in a press. A workpiece is inserted when the top and bottom molds are spaced apart from each other. When the top and bottom molds combine with each other, the blanking, piercing, forming and drawing steps are simultaneously performed using the force of the press.

In the blanking step, pilot holes are formed on the transformable area of the workpiece to convey and secure it to the right position of the next molds. And at the same time, the workpiece is blanked into the shape of a cathode ray tube while leaving junctions thereon to prevent the blanked portion from being detached therefrom. The junctions enable all the steps to be progressively exercised.

In the piercing step, a hole, which has a TV or monitor screen shape, is formed on the inner area of the blanked portion by punching it.

In the forming step, the edge of the pierced portion bends inward to be slightly inclined at an angle.

Finally, in the drawing step, the formed portion is molded into a frame while notching the junctions.

Through the above steps, a high-quality frame can be obtained because the workpiece is rigidly secured in each mold by means of the pilot pins to prevent it from shaking.

The frame manufacturing steps are sequentially exercised in one press operation. Thus, the worker need not carry the workpiece to the next mold whenever each step is finished. This not only offers convenience but also enables mass production based on improved work efficiency.

As described above, the frame manufacturing method according to the present invention progressively proceeds. That is, the blanking, piercing, forming and drawing steps can be sequentially exercised using the method. Thus, the method can be widely used, irrespective of the objects, and enables a high-quality frame to be obtained.

It will be apparent to those skilled in the art that various modifications and variations can be made in the method of manufacturing the frame for the cathode ray tubes of the present invention without departing from the spirit or scope of the invention. Thus, it is intended that the present invention cover the modifications and variations of this invention provided they come within the scope of the appended claims and their equivalents.

What is claimed is:

1. A method of manufacturing a frame for cathode ray tubes, comprising the progressive steps of:

blanking a workpiece while leaving junctions thereon and punching a transformable area of the workpiece to form pilot holes thereon;

piercing the blanked portion into the shape of a TV or monitor screen;

forming an edge of the pierced portion such that it bends inward; and drawing the formed portion to be molded into a frame while notching the junctions, wherein all of the steps are performed in one press and the steps are performed sequentially.

* * * * *